United States Patent [19]

Ihochi et al.

[11] 4,362,400

[45] Dec. 7, 1982

[54] TIMEPIECE WITH ALARM FUNCTION INCLUDING ANNULAR DIAPHRAGM TO ACCOMMODATE BATTERY

[75] Inventors: Takahiko Ihochi; Masashi Tanaka, both of Koganei; Kazuo Kojima, Tokorozawa; Yutaka Nakajima, Mitaka, all of Japan

[73] Assignee: Hitachi, Ltd., Tokyo, Japan

[21] Appl. No.: 199,975

[22] Filed: Oct. 23, 1980

[30] Foreign Application Priority Data

Oct. 24, 1979 [JP] Japan ..... 54-136403

[51] Int. Cl.[3] ..... G04C 21/16

[52] U.S. Cl. ..... 368/255; 368/88

[58] Field of Search ..... 368/250, 255, 88, 72–74

[56] References Cited

U.S. PATENT DOCUMENTS 3,879,931 4/1975 Yasuda et al. ..... 368/255
3,906,713 9/1975 Suda et al. ..... 368/255
3,940,919 3/1976 Yasuda et al. .
4,206,590 6/1980 Fukutome et al. ..... 368/72
4,250,573 2/1981 Saito ..... 368/73

FOREIGN PATENT DOCUMENTS 2829992 1/1979 Fed. Rep. of Germany .
2002932 2/1979 United Kingdom .

*Primary Examiner*—Bernard Roskoski
*Attorney, Agent, or Firm*—Antonelli, Terry and Wands

[57] ABSTRACT

A thin timepiece comprising a flattened casing, a display unit, a diaphragm having its peripheral portion carried by the casing to generate sound, a piezoelectric element mounted on the diaphragm and a module for driving the display unit and the piezoelectric element. The diaphragm and the piezoelectric element are formed ring-like so that the space in the central hole of the ring-like diaphragm and piezoelectric element is used for a part of the occupation space of the electric cell in the casing and that renewal of an electric cell is facilitated by the provision of the space for the cell in the diaphragm and the piezoelectric element.

7 Claims, 6 Drawing Figures

TIMEPIECE WITH ALARM FUNCTION INCLUDING ANNULAR DIAPHRAGM TO ACCOMMODATE BATTERY

This invention relates to a timepiece having an alarm function. Watches, especially wristwatches in current use, are supplied with power from a small electric cell to measure and display time and to warn provide an alarm at any desired point of time. A wristwatch is usually carried on the wrist and the cell as a power source must be replaced by a new one when an old cell is exhausted. It is therefore preferable that the cell should have a small thickness and be so designed that the exhausted cell may be easily replaced.

According to the present invention there is provided a timepiece comprising a flattened casing, a display unit, a diaphragm having its peripheral portion carried by the casing and serving to generate sound, a piezoelectric element mounted on the diaphragm and a module arranged to be powered by an electric cell for driving the display unit and/or the piezoelectric element, the display unit, the diaphragm, the piezoelectric element and the module being placed in the casing with the display unit being more frontward than the rest, wherein the diaphragm and the piezoelectric element are ring-like plates having holes at their centers and being substantially coaxial with each other so that the space in the holes may be occupied by at least a part of the electric cell in the casing.

Figure 1:
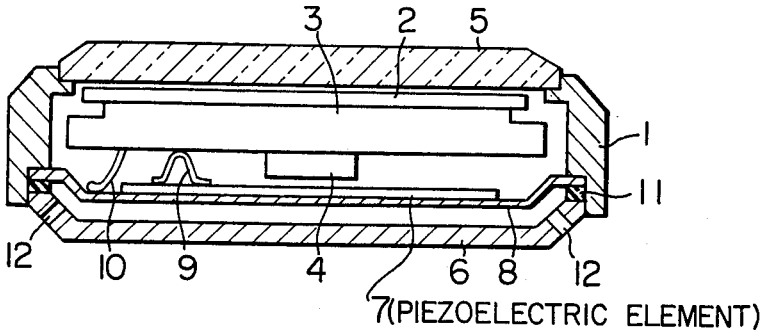
Figure 2:
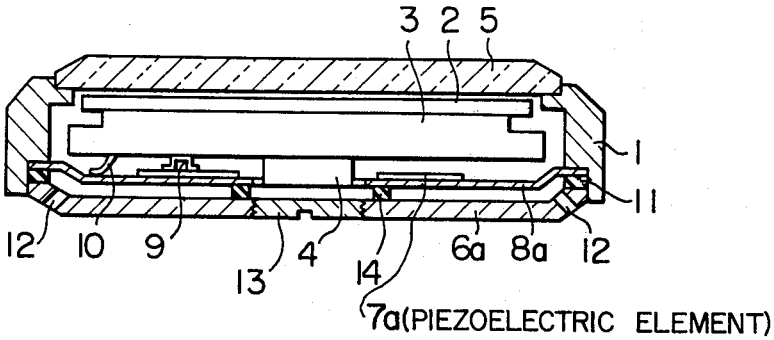
Figure 3:
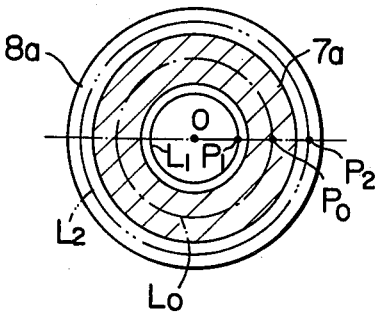

In the accompanying drawings:

FIG. 1 schematically shows in cross section a wristwatch having an alarm function;

FIG. 2 schematically shows in cross section a wristwatch having an alarm function, which forms an embodiment of this invention;

FIG. 3 shows in plan view a piezoelectric element and an associated diaphragm, used in the wristwatch shown in FIG. 2; and FIG. 4 shows a plan view different types of piezoelectric elements and an associated diaphragm to be used in this invention.

Wrist watches with an alarm function have been known to have a general structure such as shown in cross section in FIG. 1. This wristwatch incorporates in its casing 1 a liquid crystal display unit 2, a module 3 for driving the liquid crystal display unit 2, and an electric cell 4 inserted into the module 3. The top side of the case 1, where the display unit 2 appears, is covered with a transparent glass cover 5 while the bottom side of the casing 1, where the module 3 is placed, is covered with a detachable back cover 6. Over the inner surface of the back cover 6 is disposed a circular vibration plate or diaphragm 8 to which a disc-like piezoelectric element 7 is attached. The piezoelectric element 7 is driven also by the module 3. One main electrode of the element 7 is in contact with an output contact 9 extending from the module 3 and a grounding contact 10 extending from the module 3 is in contact with the diaphragm 8 which is in electrical contact with the other main electrode of the element 7. A packing 11 is interposed between the peripheral portion of the diaphragm 8 and the back cover 6 so as to provide a watertight sealing. Sound outlet openings 12 are cut in the peripheral portion of the back cover 6.

With the wristwatch having such a structure as described above, the displayed time is seen through the transparent glass cover and at previously set times a voltage is applied to the piezoelectric element 7 so that the diaphragm 8 vibrates to generate sound. This sound is delivered through the sound outlet openings 12 outwardly of the casing 1, indicating that the preset times have been reached.

However, this type wristwatch has a drawback that when the exhausted electric cell is replaced by a new one, the diaphragm 8 as well as the back cover 6 must be detached.

Moreover, if the cell were brought into contact with the diaphragm 8, the vibration of the diaphragm 8 would be partly or completely prevented. Accordingly, there must be an enough gap for allowing the diaphragm to vibrate, between the cell and the diaphragm 8. Further, since the electric cell 4 usually protrudes from the surface of the module 3, this structure leads to an inconvenience that the overall watch is rather thick.

FIG. 2 shows in cross section a wristwatch as an embodiment of this invention. As shown in FIG. 2, this wristwatch has a ring-shaped casing 1 which incorporates therein a liquid crystal display unit 2, a module 3 for driving the liquid crystal display unit 2 and an electric cell 4 inserted into the module 3. The top side of the ring-shaped casing 1, where the display face of the unit 2 appears, is covered with a transparent glass cover 5 while the bottom side of the casing 1, where the module 3 is placed, is covered with a detachable back cover 6*a*. Near the back cover 6*a* is disposed a ring-like diaphragm 8*a* on which a ring-like piezoelectric element 7*a* is attached. The diaphragm 8*a* and piezoelectric element 7*a* respectively have coaxial center holes, and they and their holes are substantially coaxial with each other. The piezoelectric element 7*a* is driven by the module 3. The output contact 9 extending from the module 3 is in contact with one of the two main electrodes of the element 7*a* and the grounding contact 10 extending from the module 3 is in contact with the diaphragm 8*a* kept in electrical contact with the other main electrode of the element 7*a*. The diaphragm 8*a* is mounted on the casing 1, with its peripheral portion supported by the casing so as to be free in vibration. When a voltage is applied to the piezoelectric element 7*a*, the element 7*a* vibrates so that the diaphragm 8*a* fixed to the element 7*a* also vibrates to generate sound.

FIG. 3 shows a relative arrangement of the diaphragm 8*a* and the piezoelectric element 7*a*. Namely, the ring-like piezoelectric element 7*a* (shown by a shaded annulus) is so disposed on the ring-like diaphragm 8*a* as to lie between the above-mentioned peripheral portion and the circumference of the center hole of the diaphragm 8*a* substantially coaxially. Preferably, the shapes, dimensions and relative positions of the ring-like diaphragm 8*a* and piezoelectric element 7*a* should be so determined that the distance $P_1P_0$ may be substantially equal to the distance $P_0P_2$ in FIG. 3. Here, $L_0$ indicates a circle with a radius equal to the mean of the outer and inner radii of the ring-like element 7*a*; $L_1$ a circle identical with the circumference of the center hole of the diaphragm 8*a* or a circle identical with the inner circumference of the effective area of the diaphragm 8*a* contributing to vibration under support by the casing 1; $L_2$ a circle identical with the outermost nodal line of the diaphragm in vibration under support by the casing 1 or a circle identical with the outer circumference of the above-mentioned effective area of the diaphragm 8*a*; and $P_1$, $P_0$ and $P_2$ respectively the points of intersection of the straight line passing through the common center 0 with the circles $L_1$, $L_0$ and $L_2$. With this geometry, the diaphragm 8*a*, driven by the element 7*a*, vibrates at a frequency equal to that of the second higher harmonic of the natural vibration frequency thereof and in this case the generated sound is maximum.

On the other hand, the electric cell 4 is inserted through the central holes of the diaphragm 8*a* and the piezoelectric element 7*a* into the module 3 and a part of the cell 4 almost occupies the space in the holes, with a small gap between the cell 4 and the diaphragm 8*a*. This structure allows the thickness of the completed watch to be reduced by several mm, e.g. 2–3 mm. A hole, through which the exhausted electric cell is replaced by a new one, is cut in the central area of the back cover 6*a*. The edge of the hole is threaded and a threaded disc-shaped lid or plate piece 13 is fitted in the hole. When, therefore, the replacement of the cell takes place, the lid 13 is detached by unscrewing. In this case, there is no need for detaching the diaphragm 8*a* as in the watch shown in FIG. 2. This facilitates the treatment of the watch. Sound outlet holes 12 are cut through the back cover 6*a* and elastic packings 11 and 14 are provided between the diaphragm 8*a* and the back cover 6*a*, the packings 11 and 14 being at the outer periphery of the diaphragm and at the inner periphery of the diaphragm, respectively, to assure watertight sealing and stable support of the diaphragm.

Figure 4A:
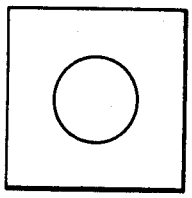
Figure 4B:
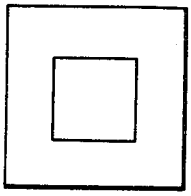
Figure 4C:
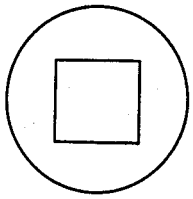

FIGS. 4A to 4C show in plan other shapes which may be assumed by the diaphragm 8*a* and the piezoelectric element 7*a*. In the examples in FIG. 4A, the outer periphery is square and the inner periphery is circular. In FIG. 4B, both the outer and inner peripheries are square. In FIG. 4C, the outer periphery is circular and the inner periphery square. In the embodiment shown in FIG. 3, it is apparent that both the peripheries are circular. Further, the diaphragm and the piezoelectric element may have the shape of one-half of any of those shown in FIGS. 4A to 4C.

Any possible combinations of the shapes shown in FIGS. 4A to 4C may be adopted for the diaphragm 8*a* and the piezoelectric element 7*a*, but it is preferable that they should be similar in shape. Their relative positions are as shown in FIG. 3 and described with reference thereto.

As has been described above, according to this invention, the space for the buzzer (diaphragm) is effectively used so that the thickness of the watch can be reduced. Accordingly, a wristwatch for women, which is usually small in size, can also be provided with an alarm function. Further, according to the structure embodying this invention, the replacement of the exhausted electric cell is very easy since it is only necessary to unscrew the cell lid.

What we claim is:

1. A timepiece comprising a casing having a transparent viewing surface; a display unit mounted adjacent said transparent viewing surface; a diaphragm having its peripheral portion carried by the casing and serving to generate sound; a piezoelectric element mounted on the diaphragm; and a module arranged to be powered by an electric cell for driving at least one of the display unit and the piezoelectric element; the display unit, the diaphragm, the piezoelectric element and the module being mounted in said casing with said diaphragm being disposed on the opposite side of said module and said display unit from said viewing surface; wherein the diaphragm and the piezoelectric element are ring-like plates each having holes at their centers which are substantially coaxial with each other, the space provided by the holes in said diaphragm and said piezoelectric element being used to accommodate at least a part of the electric cell in the casing.

2. A timepiece according to claim 1, wherein the casing has a back cover having a central hole substantially coaxial with the holes in the diaphragm and the piezoelectric element, and a plate piece is in a detatchable engagement with the back cover at its central hole for use in replacement of an electric cell.

3. A timepiece according to claim 2, wherein the plate piece is in a threaded engagement with the back cover.

4. A timepiece according to claim 1, 2 or 3, wherein the dimensions of the diaphragm are such that the diaphragm is capable of vibrating at the frequency of the second higher harmonic of the natural vibration frequency of the diaphragm.

5. A timepiece comprising a casing, a display unit, a disc diaphragm, a piezoelectric element mounted on the diaphragm, a module arranged to be powered by an electric cell to drive at least one of the display unit and the piezoelectric element and a back cover, the display unit, the diaphragm, the piezoelectric element and the module being placed within the casing, the diaphragm being secured to the casing so as to be able to vibrate and the back cover having openings for delivering outwardly sound generated by the diaphragm, wherein the piezoelectric element is ring-like, the ring-like piezoelectric element and the disc diaphragm have at their centers holes substantially coaxial with each other, the back cover has a central hole overlapping with the holes of the diaphragm and the piezoelectric element so that the space in the holes of the diaphragm and the piezoelectric element are usable for occupation by the electric cell and the central hole in the back cover is usable for renewal of the electric cell.

6. A timepiece according to claims 1 or 5, wherein said diaphragm exhibits a plurality of concentric nodal lines in vibration, and the diaphragm and the piezoelectric element are superimposed on one another so that the spacing between a first point located on the edge of the hole in said diaphragm and a second point located midway between the inner and outer edges of said piezoelectric element is equal to the spacing between said second point and a third point located on the outermost nodal line of the diaphragm in vibration when said first, second and third points all lie on a common radial line.

7. A timepiece according to claims 1 or 5, wherein said piezoelectric element is mounted on said diaphragm so as to cover the mid-portion of the diaphragm between inner and outer circles defining the effective area of the diaphragm which is subjected to vibration by said piezoelectric element and to extent along a circular line defined by the mean between said inner and outer circles.

* * * * *